United States Patent [19]

Heien

[11] 3,946,568

[45] Mar. 30, 1976

[54] OFFSHORE OIL PRODUCTION PLATFORM

[76] Inventor: Sigurd Heien, Aslokkvn. 82, 1362 Billingstad, Norway

[22] Filed: Mar. 24, 1975

[21] Appl. No.: 561,376

[52] U.S. Cl. ..... 61/46.5; 114/.5 T
[51] Int. Cl.[2] ..... E02D 21/00; B63B 35/44
[58] Field of Search ..... 61/46.5, 46; 114/.5 T

[56] References Cited

UNITED STATES PATENTS

| | | | |
|---|---|---|---|
| 3,708,987 | 1/1973 | Roulet | 61/46 |
| 3,738,113 | 6/1973 | Madary et al. | 61/46.5 |
| 3,824,795 | 7/1974 | Mo | 61/46.5 |
| 3,886,753 | 6/1975 | Birdy et al. | 61/46.5 |

*Primary Examiner*—Jacob Shapiro
*Attorney, Agent, or Firm*—Young & Thompson

[57] ABSTRACT

An offshore oil production platform comprising one section disposed on the sea bed and another section connected to the one section and projecting up above the sea surface. The one section consists of a plurality of prefabricated units comprising at least one tank divided into a plurality of compartments and having a peripheral wall the thickness of which is not adapted to withstand full water pressure with the tank empty in the submerged state, and at least one compartment in the tank has a peripherial wall the thickness of which is adapted to withstand full water pressure when empty in the submerged state.

6 Claims, 4 Drawing Figures

OFFSHORE OIL PRODUCTION PLATFORM

The invention relates to an offshore oil production platform comprising a first section which is disposed on the sea bed and a second section which is connected to the first section and projects above the surface of the sea, the first section consisting of a plurality of prefabricated units of steel or concrete which, in the floating state, are interconnected and comprises at least one tank which is divided into a plurality of compartments.

In the exploitation of oil on the sea bed at great depths, the drilling of necessary holes is carried out from floating platforms and the recovery of the oil is carried out by apparatus disposed on the sea bed. From such apparatus, the oil and/or gas is conducted to the surface through pipes for loading onto ships by means of anchored buoys or tank units or is conveyed to land via pipe-lines. This requires underwater stations where personnel must carry out complex operations under great pressure. Further, the means wherein the personnel are to be accommodated and are to work must be ensured normal air supply and be provided with safe transport to and from the sea bed.

The necessary transport can be carried out by means of diving bells or under-water vessels, however, this is time-consuming and expensive and entails risk of both pollution and accidents having grave consequences.

The object of the invention is, therefore, to provide a production platform of the type described hereinabove which permits the use of known working methods for oil and gas production at greater depths and under normal conditions.

According to the invention this is achieved in that the tank, in the first part thereof, has a peripheral wall the thickness of which is not adapted to withstand full water pressure when the tank is empty and submerged, and that at least one compartment in the tank has a peripheral wall the thickness of which is adapted to withstand full water pressure when the compartment is empty and submerged. In this manner, with relatively reasonable material consumption and expedient ballasting by water and/or gas filling of the tanks, it is possible to submerge the first section to the desired contact with the sea bed.

According to the invention, in several compartments in the tank, the partition walls in the compartments between the peripheral walls of the tank and the central compartment may be of a thickness which is not adapted to withstand full water pressure when empty and submerged.

According to the invention, for further stabilization during submersion and support of the other section, at least the central compartment can extend upwardly substantially above the height of the remainder of the tank, and form internal connection to the second section.

According to the invention, in order to increase the tank capacity and further stabilize the submersion, each unit may have at least one further tank of smaller cross-sectional area and greater height than the main tank and a peripheral wall which is adapted to withstand full water pressure when empty and submerged.

According to the invention, in order to adapt the second part of the sea depth, the second section can be self-supporting in that it floats in the water and, in addition to the said connection, is secured by cables to the first section.

In this manner, a slidable connection between the two sections is achieved the upper portion of the second chamber comprising a chamber for the personnel and necessary equipment can be received and stored therein.

An embodiment example of the invention is further explained hereinbelow with reference to the drawings.

Figure 1:
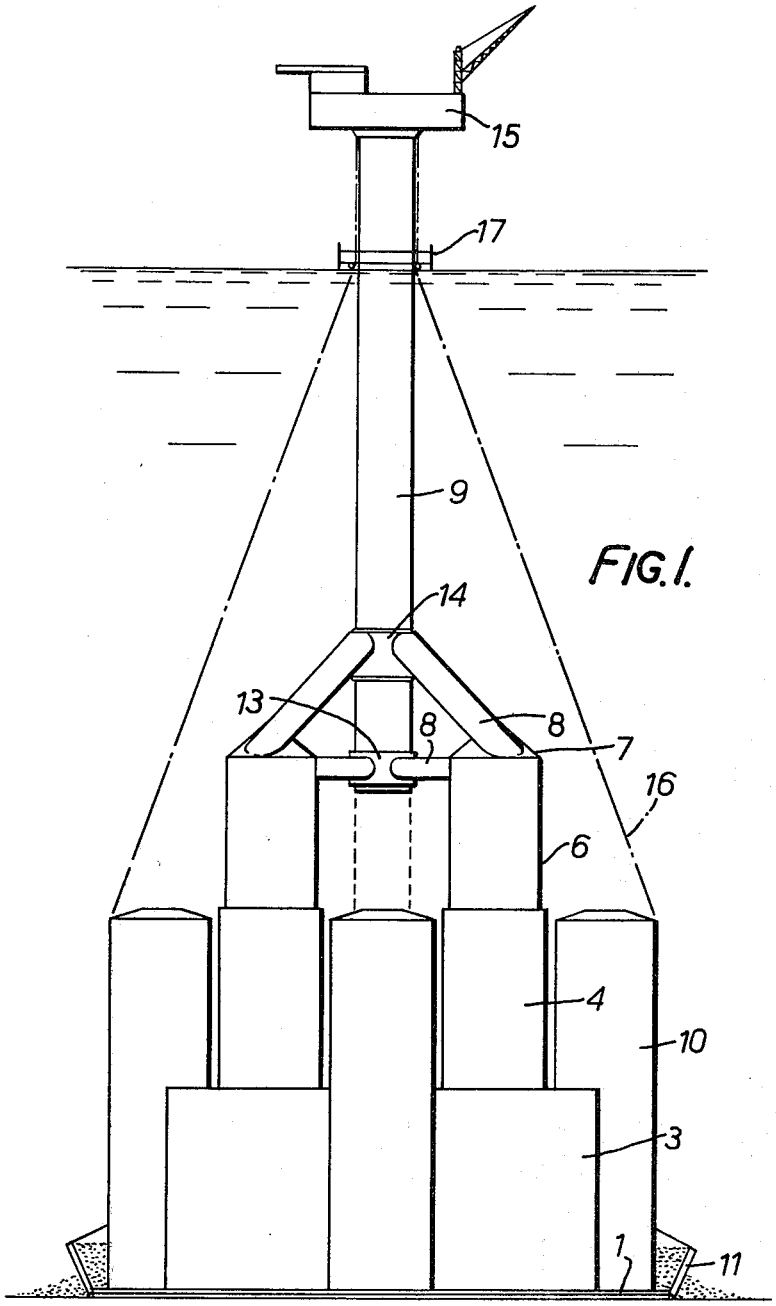
FIG. 1 is a view of a production platform according to the invention.
Figure 2:
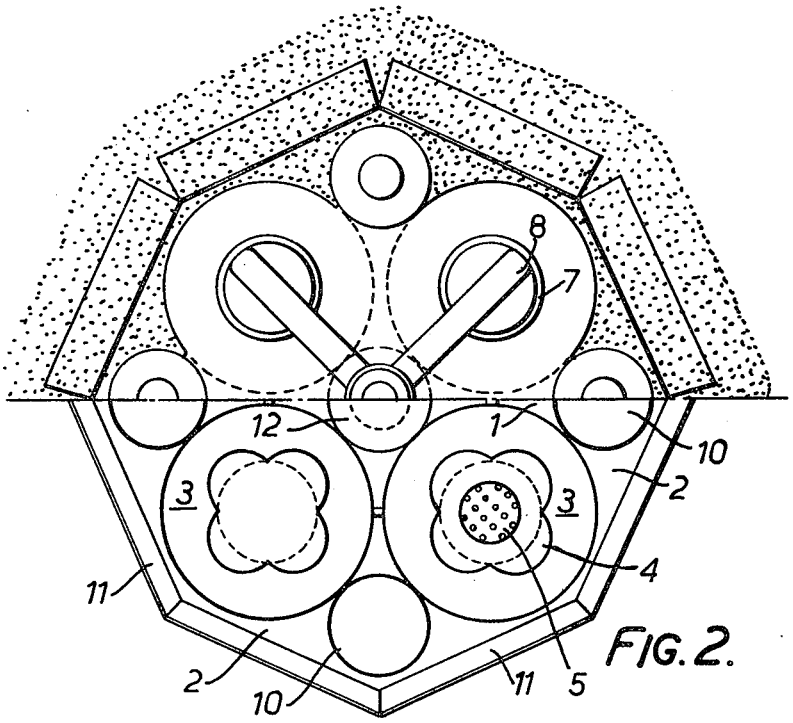
FIG. 2 is a horizontal projection in partial section of the first section of the production platform of FIG. 1.

As illustrated, the production platform according to the embodiment of FIGS. 1 and 2 consists of an octagonal base plate 1 which is assembled from four quadrants 2 two of which are illustrated in horizontal elevation and two in cross-section in FIG. 2. Each quadrant has a main tank 3 the peripheral wall of which is not adapted to withstand full water pressure with empty tank in the submerged state, for example, at a depth of 250 meters. In each main tank 3, two concentric compartments 4 and 5 are concentrically arranged, the peripheral walls of which are not in contact with the peripheral wall of the main tank, and are adapted to withstand full water pressure when empty in the submerged state, the height of said tanks extending substantially above the main tank 3, and said tanks are provided with extensions 6, the upper ends 7 of which are provided with support members 8 for the column 9 of the second section and provide passage thereto. Furthermore, the base plate 1 is provided with four further tanks 10, the peripheral walls of which are also adapted to withstand full water pressure when the tank is empty and submerged. Along the circumference of the base plate 1, flaps 11 are hinged which, in their upwardly pivoted state define storage for ballast and stabilizing material which is released onto the sea bed to stabilize the sea bed and prevent erosion around and under the base plate.

The second section consists of a pipe 9 the lower end of which projects downwardly, telescopically displaceable, into a central tank 12 the peripheral wall of which is adapted to withstand full water pressure when empty and submerged. The pipe 9 is supported in sleeve-shaped members 13, 14 which are supported by support members 8. The upper end of the pipe 9 is provided with a platform 15 for crew accommodation, etc., and is further supported on the first section by means of cables 16.

By means of ballast material and its own weight, the production platform will float at a level with the upper edge of the main tanks 3 and, on filling these with water, the entire unit is submerged in accordance with the water filling the main tanks 3 and, when these are full, the outer water pressure is transferred to the peripheral wall in the compartment 4 therewithin so that the peripheral wall in the main tanks 3 is relieved and does not need to withstand full water pressure on the sea bed and be of lesser dimension than the peripheral walls of the other tanks. Due to the large diameter of the main tank, for example 45 meters, a substantial weight and material saving is thus achieved. When the main tanks 3 are filled, the unit floats at a level with the upper edge of the tanks 10, so that the extensions 6, support members 8 and the other sections 9, 15 are above the surface of the water. By filling the compartments 4 with water, the unit is submerged to the sea bed and any adjustment of the base plate to horizontal position can be carried out in that the filling of the compartments 4 is regulated. The intermediate space between the sea bed and the base plate can be filled with concrete injections through the central compartment 5 in the main tanks. Due to the ballast material, the centre of gravity of the entire unit will be below the centre of buoyancy so that the necessary stability during submersion is achieved. When the entire unit has reached the desired position on the sea bed, all the tanks, with the exception of the central compartment 5 with extensions 6, support members 8 and pipe 9, are filled with water as ballast for compensation of the air in parts 6, 8, 9. The drilling is carried out through the bottom of the compartments 5 and storage of oil occurs in that the oil displaces the water in the tanks. Ventilation channels and pipes for oil or gas, respectively, are passed through the support members and the pipe 9, which is also provided with transport means for crew and equipment. The platform 15 can also be provided with cranes and apparatus for loading and unloading of equipment and machinery for drilling, etc. Around the upper part of the pipe 9, a platform 17 can be mounted at a level which facilitates access to the production platform from vessels.

Figure 4:
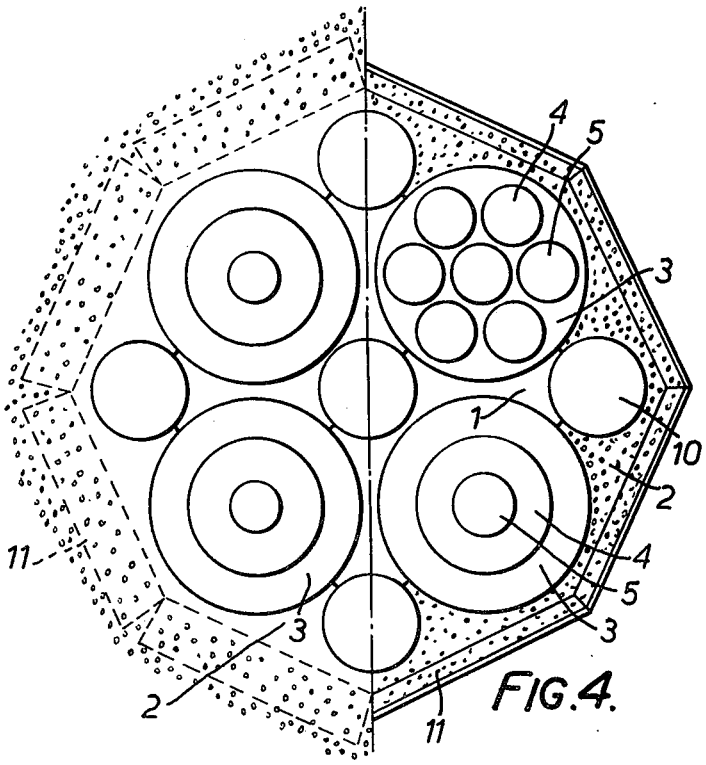
FIG. 4 is a horizontal projection of the production platform of FIG. 3.
Figure 3:
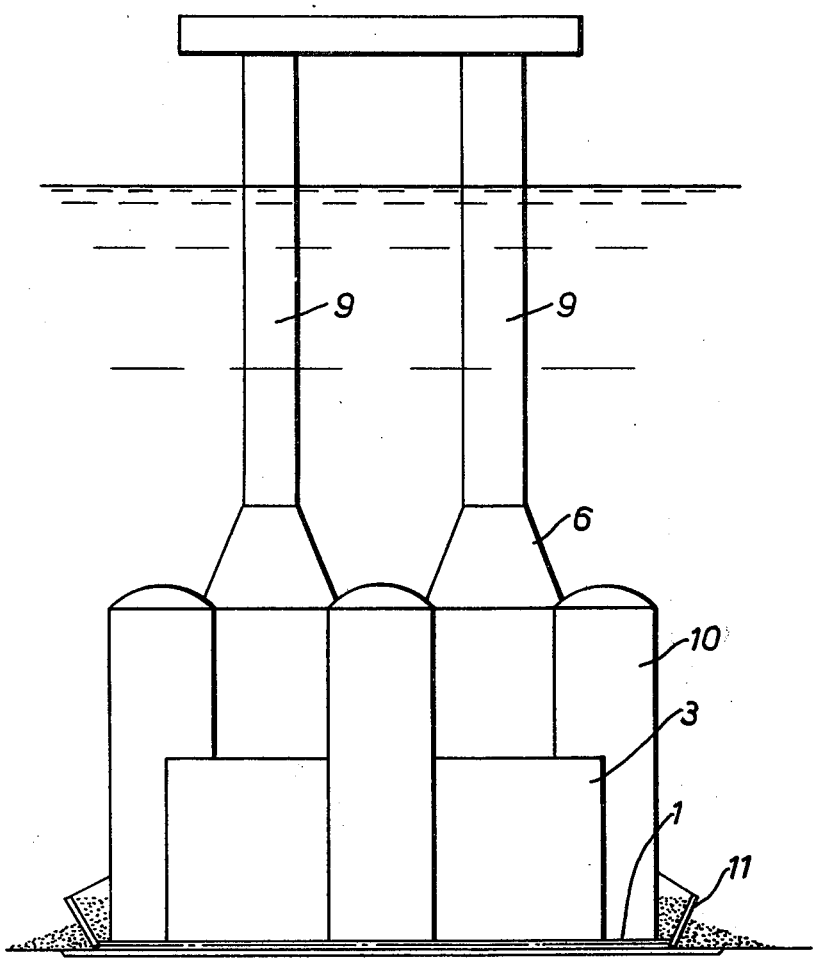
FIG. 3 shows in the same manner as FIG. 1 a second embodiment example of a production platform according to the invention.

The embodiment of FIGS. 3 and 4 is intended for lesser depth than the embodiment of FIGS. 1 and 2 but corresponds substantially to this embodiment, with the exception that, in the main tanks, the radial support walls are removed in order to save weight and concrete respectively. Further, the second section is formed as an extension of the first section with at least two tubular columns which support the platform. The same reference numbers are used, therefore, for the corresponding parts of the production platform of FIGS. 3 and 4 as of FIGS. 1 and 2.

As will be apparent from the upper right-hand quadrant of FIG. 4, the compartments 4 can be arranged eccentrically and any of the compartments 4 and 5 can be formed as an extension of the first section as the column for supporting the platform.

Having described my invention, I claim:

1. Offshore oil production platform comprising a first section disposed on the sea bed and a second section connected to the first section and projecting up above the sea surface, the first section consisting of a plurality of interconnected prefabricated units of steel or concrete and comprises at least one tank which is divided into a plurality of compartments, characterized in that the tank in the first section has a peripheral wall the thickness of which is not adapted to withstand water pressure with the tank empty and submerged, and at least one compartment in the tank has a peripheral wall the thickness of which is adapted to withstand full water pressure when empty and submerged.

2. Production platform according to claim 1, and partition walls in the tank defining compartments between the peripheral wall of the tank and the last-named compartment, said partition walls being of a thickness which is not adapted to withstand full water pressure when the tank is empty and submerged.

3. Production platform according to claim 2, characterized in that at least the last-named compartment extends upwardly to a height substantially above the remainder of the tank and forms support of and internal connection to the second section.

4. Production platform according to claim 3, characterized in that each unit has at least one further tank of smaller cross-sectional area and greater height than the main tank, the peripheral wall of said further tank being adapted to withstand full water pressure with the tank empty and submergd.

5. Production platform according to claim 4, characterized in that the second section is selfsupporting, in that it floats in the water and, in addition to the said connection, is secured by cables to the first section.

6. Production platform according to claim 1, characterized in that said tanks and compartments are of circular cross section and have parallel axes.

* * * * *